US007573452B2

(12) United States Patent
Nathan et al.

(10) Patent No.: US 7,573,452 B2
(45) Date of Patent: Aug. 11, 2009

(54) INTEGRATED MULTIPLEXER/DE-MULTIPLEXER FOR ACTIVE-MATRIX DISPLAY/IMAGING ARRAYS

(75) Inventors: Arokia Nathan, Waterloo (CA); Karim S. Karim, Coquitlam (CA); Nitin Mohan, Kitchener (CA); Anil Kumar, Kitchener (CA); Kapil Sakariya, Kitchener (CA)

(73) Assignee: Ignis Innovation Inc., Cambridge, Ontario (CA)

( * ) Notice: Subject to any disclaimer, the term of this patent is extended or adjusted under 35 U.S.C. 154(b) by 563 days.

(21) Appl. No.: 10/487,034

(22) PCT Filed: Aug. 15, 2002

(86) PCT No.: PCT/CA02/01290

§ 371 (c)(1),
(2), (4) Date: Jul. 26, 2004

(87) PCT Pub. No.: WO03/017241

PCT Pub. Date: Feb. 27, 2003

(65) Prior Publication Data

US 2005/0007352 A1 Jan. 13, 2005

(30) Foreign Application Priority Data

Aug. 15, 2001 (CA) ..... 2355067

(51) Int. Cl.
*G09G 3/36* (2006.01)

(52) U.S. Cl. ..... 345/92; 345/94; 345/98; 345/100; 345/103

(58) Field of Classification Search ..... 345/204, 345/87, 98, 103, 90–94, 100, 104, 77, 211, 345/76, 79, 212; 348/790; 327/147, 331; 313/483; 377/54, 98; 351/212; 326/98
See application file for complete search history.

(56) References Cited

U.S. PATENT DOCUMENTS

| | | | | |
|---|---|---|---|---|
| 4,758,831 | A * | 7/1988 | Kasahara et al. | 345/94 |
| 4,963,860 | A * | 10/1990 | Stewart | 345/206 |
| 4,975,691 | A * | 12/1990 | Lee | 345/79 |
| 5,051,739 | A | 9/1991 | Hayashida et al. | |
| 5,222,082 | A * | 6/1993 | Plus | 377/79 |
| 5,686,935 | A * | 11/1997 | Weisbrod | 345/100 |
| 5,712,653 | A | 1/1998 | Katoh et al. | |
| 5,784,042 | A * | 7/1998 | Ono et al. | 345/94 |
| 5,790,234 | A * | 8/1998 | Matsuyama | 351/212 |
| 5,870,071 | A | 2/1999 | Kawahata | |
| 6,232,939 | B1 | 5/2001 | Saito et al. | |
| 6,300,928 | B1 * | 10/2001 | Kim | 345/92 |
| 6,345,085 | B1 * | 2/2002 | Yeo et al. | 377/54 |
| 6,597,203 | B2 * | 7/2003 | Forbes | 326/98 |
| 6,661,397 | B2 * | 12/2003 | Mikami et al. | 345/76 |

(Continued)

FOREIGN PATENT DOCUMENTS

WO WO 94/25954 11/1994

*Primary Examiner*—Prabodh M. Dharia
(74) *Attorney, Agent, or Firm*—Pearne & Gordon LLP

(57) ABSTRACT

Integrated multiplexer/de-multiplexer for a pixel array is provided. A drive circuit having the de-multiplexer is provided to a gate line arranged for a pixel array. A pixel is selected using the drive circuit. A read circuit having the multiplexer is provided to a data line arranged for the pixel array. Data output from a pixel is read using the read circuit.

29 Claims, 15 Drawing Sheets

U.S. PATENT DOCUMENTS

| | | | | |
|---|---|---|---|---|
| 6,873,320 | B2 * | 3/2005 | Nakamura | 345/204 |
| 2001/0020926 | A1 * | 9/2001 | Kuijk | 345/87 |
| 2001/0026121 | A1 * | 10/2001 | Khan et al. | 313/483 |
| 2001/0026179 | A1 * | 10/2001 | Saeki | 327/147 |
| 2001/0052898 | A1 * | 12/2001 | Osame et al. | 345/211 |
| 2002/0011981 | A1 * | 1/2002 | Kuijk | 345/92 |
| 2002/0015031 | A1 * | 2/2002 | Fujita et al. | 345/204 |
| 2002/0015032 | A1 * | 2/2002 | Koyama et al. | 345/204 |
| 2002/0030528 | A1 * | 3/2002 | Matsumoto et al. | 327/331 |
| 2002/0080108 | A1 * | 6/2002 | Wang | 345/90 |
| 2002/0101433 | A1 * | 8/2002 | McKnight | 345/589 |
| 2002/0130686 | A1 * | 9/2002 | Forbes | 326/98 |
| 2002/0154084 | A1 * | 10/2002 | Tanaka et al. | 345/92 |
| 2002/0190971 | A1 * | 12/2002 | Nakamura et al. | 345/204 |

* cited by examiner (de-multiplexer using pull-up/pull-down architecture)

(pull-up/pull-down de-multiplexer with a pull-up TFT instead of a resistor)

(multiplexer with output buffer)

(cascaded multiplexers configuration)

(cascaded de-multiplexers configuration)

INTEGRATED MULTIPLEXER/DE-MULTIPLEXER FOR ACTIVE-MATRIX DISPLAY/IMAGING ARRAYS

FIELD OF THE INVENTION

This invention relates in general to an apparatus for reading and/or writing data in active matrix display and imaging arrays. The active matrix can be derived from both inorganic and organic materials that are amorphous or polycrystalline.

BACKGROUND OF THE INVENTION

The most popular addressing method in large area displays is active matrix addressing where the gate and data lines form the rows and columns of the grid-like structure.

FIG. 1 is a diagram showing an active matrix array 100 of an active matrix display. The active matrix array 100 has a plurality of pixels 106. The pixels are controlled by transistors in the electronic backplane. The active matrix array has at least one transistor per pixel that acts as an analog switch. The switching transistor either enables or disables writing of data to that pixel. In FIG. 1, Thin Film Transistor (TFT) 108 is shown as the switching transistor, which is connected to a data line 102 and a gate line 104. The switching transistors of the display array are controlled by a de-multiplexer (also known as a gate driver). The purpose of the gate driver is to sequentially activate every row of the display while data is being written to that row. This data is stored and retained by the active pixels until they get new data in the next frame. This method of writing data to a display array is known as row-by-row addressing.

Currently, amorphous silicon (a-Si:H), polycrystalline silicon, or organic/polymer materials can be used for making the switching transistors in display pixels.

In a-Si:H and polycrystalline silicon, the TFTs suffer from electrical-stress induced meta-stability problems. Therefore, they are not usually used in the implementation of the driving circuitry.

However, if the metastability problems can be overcome, there are significant benefits including cost savings in implementing integrated gate drivers on the display instead of having external chips.

It is also desirable to provide a gate multiplexers/de-multiplexers that can also be integrated with active-matrix imaging arrays, where the imaging pixels are activated row-by-row during image read-out.

SUMMARY OF THE INVENTION

The objective of this invention is to provide an integrated gate de-multiplexer and read-out multiplexer that can be integrated on to a a-Si:H, poly-crystalline silicon, or organic/polymer display or imaging arrays. Further, it is an object of the present invention to provide an integrated gate de-multiplexer and read-out multiplexer that overcomes the material metastability, and has threshold voltage (Vt-shift) invariant operation over the lifetime of the array.

In accordance with an aspect of the present invention, there is provided a drive circuit for driving a pixel array, which includes an output terminal for driving a transistor in a pixel array, a drive transistor for transferring a gate selecting signal to the output terminal, and one or more control transistors for switching the drive transistor in response to one or more control signals. The drive transistor, the control transistors and the transistor in the pixel array are thin film transistors.

In accordance with a further aspect of the present invention, there is provided a driver for driving a pixel array. The pixel array includes a plurality of gate lines, each of which is connected to a gate of a switching transistor. The driver includes a plurality of de-multiplexers, each of which drives a corresponding gate line in a pixel array, and one or more control signal lines for activating the de-multiplexers. The de-multiplexer includes an output terminal connected to the corresponding gate line in the pixel array, a drive transistor for transferring a gate selecting signal to the output terminal, and one or more control transistors for switching the drive transistor in response to control signals from the control signal lines. The drive transistor, the control transistors and the switching transistor in the pixel array are thin film transistors.

In accordance with a further aspect of the present invention, there is provided a read circuit for reading data from a data line in a pixel array. The read circuit includes an input terminal connected to a data line in a pixel array, data in the pixel array transferred to the data line by a transistor in the pixel array, an output terminal, a drive transistor for transferring the data to the output terminal and one or more control transistors for switching the drive transistor in response to one or more control signals. The drive transistor, the control transistors and the transistor in the pixel array are thin film transistors.

In accordance with a further aspect of the present invention, there is provided a read circuit for reading data from an pixel array. The pixel array includes a plurality of data lines, each of which is connected to a transistor for transferring data to the data line. The read circuit includes a plurality of multiplexers, each of which is connected to a data line in a pixel array and one or more control signal lines for activating the multiplexers. The multiplexer includes an input terminal connected to a corresponding data line in the pixel array, an output terminal, a drive transistor for transferring the data to an output terminal and one or more control transistors for switching the drive transistor in response to one or more control signals. The drive transistor, the control transistors and the transistor in the pixel array are thin film transistors.

In accordance with a further aspect of the present invention, there is provided a drive circuit for driving a pixel array, which includes a pull up network circuit for pulling up a gate voltage of a switching transistor in a pixel array in response to a gate selecting signal, and a pull down network circuit for pulling down the gate voltage in response to one or more control signals. The pull down network circuit includes one or more transistors. The transistors of the pull down network circuit and the switching transistor are thin film transistors.

According to the invention, gate de-multiplexers and read-out multiplexers can be integrated into arrays, such as active-matrix display/imaging arrays, and the integrated gate de-multiplexers and read-out multiplexers can ensure stability of the transistor.

Other aspects and features of the present invention will be readily apparent to those skilled in the art from a review of the following detailed description of preferred embodiments in conjunction with the accompanying drawings.

BRIEF DESCRIPTION OF THE DRAWINGS

The invention will be further understood from the following description with reference to the drawings in which.

DETAILED DESCRIPTION OF THE PREFERRED EMBODIMENTS

Figure 1:
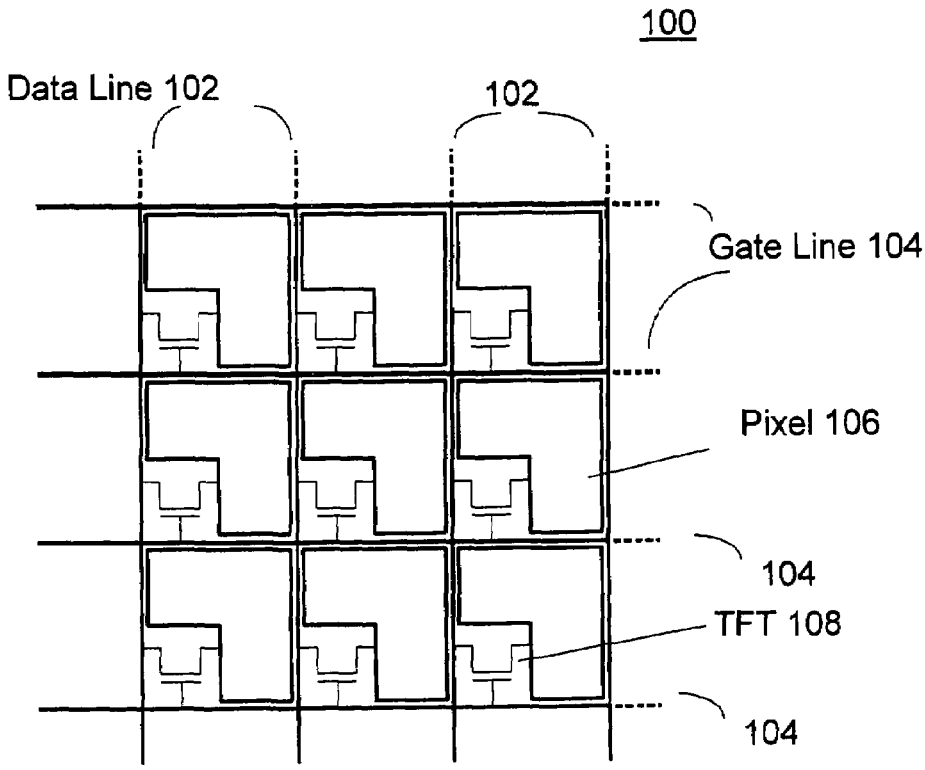
FIG. 1 (Prior Art)
FIG. 1 is a schematic diagram showing a general active matrix array.
Figure 2:
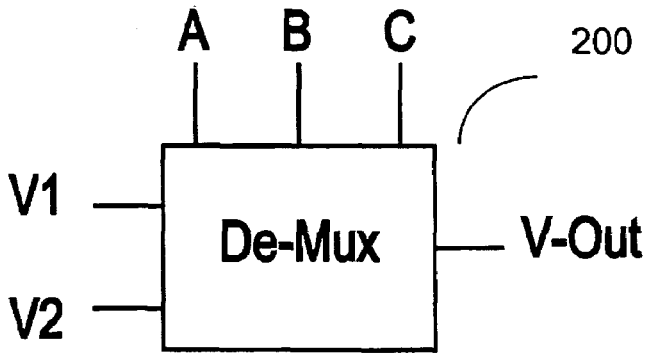
FIG. 2 is a block diagram showing a de-multiplexer circuit block 200 in accordance with one embodiment of the present invention.

A gate de-multiplexer circuit block 200 in accordance with one embodiment of the present invention is presented in FIG. 2. The gate de-multiplexer circuit block 200 has terminals V1 and V2, control terminals A, B and C and an output terminal V-Out. As described below, the output terminal V-Out may be connected to a gate line that activates a switching transistor of a pixel. The gate de-multiplexer circuit block 200 includes a plurality of TFTs, which may be a-Si:H, poly-crystalline silicon, or organic/polymer TFTs. The TFTs are connected in series, and whose gate terminals are controlled by external control signals A, B, and C. The gate de-multiplexer 200 can be fabricated on the pixel arrays.

Figure 3:
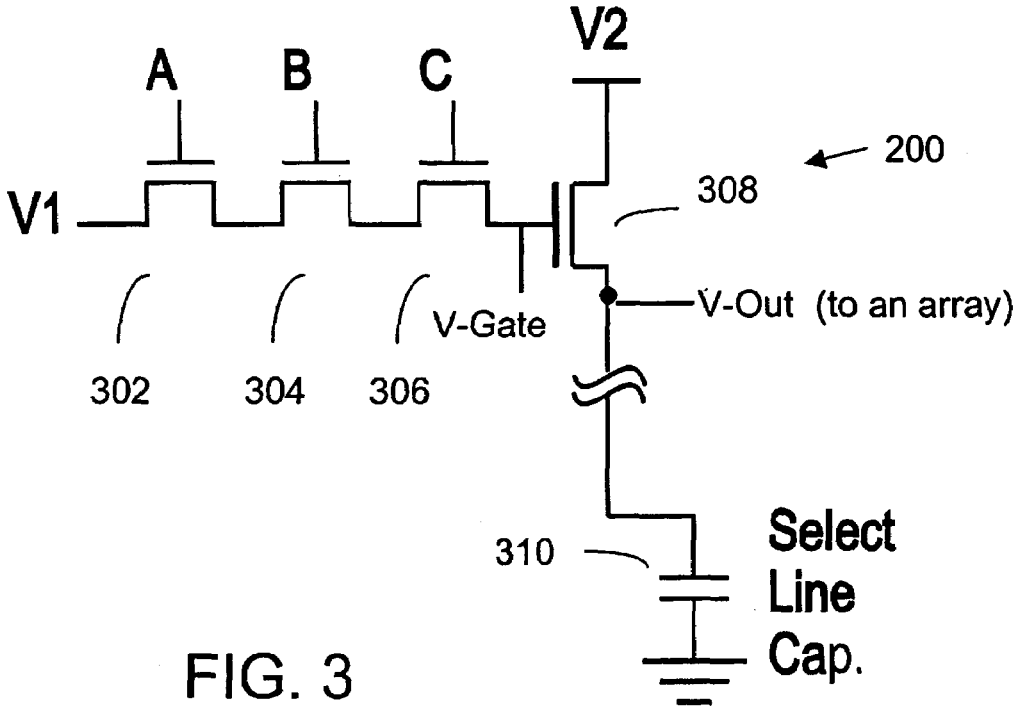
FIG. 3 is a circuit diagram showing one example of the de-multiplexer circuit block 200 of FIG. 2.

FIG. 3 shows one example of the gate de-multiplexer circuit block 200 of FIG. 2. In FIG. 3, the gate de-multiplexer includes TFTs 302, 304 and 306 that are connected in series.

The gates of the TFTs 302, 304 and 306 are connected to the control lines A, B, C, respectively. Only 3 TFTs 302, 304 and 306 and 3 control signals A, B and C are shown in FIG. 3. However, the gate de-multiplexer may have any number of TFTs which receive corresponding control signals. The number of TFTs and control signals 'N' is determined by the number of rows in a display array, and is given by N=log2 [number of rows]. The number of columns in the array does not determine the gate de-multiplexer size.

Pulsed voltage V1 is applied at one end of the series of TFTs, and the other end drives the gate of a relatively large drive TFT 308. The drain of the TFT 308 is connected to a pulsed voltage V2, and its source terminal V-Out is connected to one row line of the array. In FIG. 3, "310," denotes a capacitance of a selected line.

Figure 4:
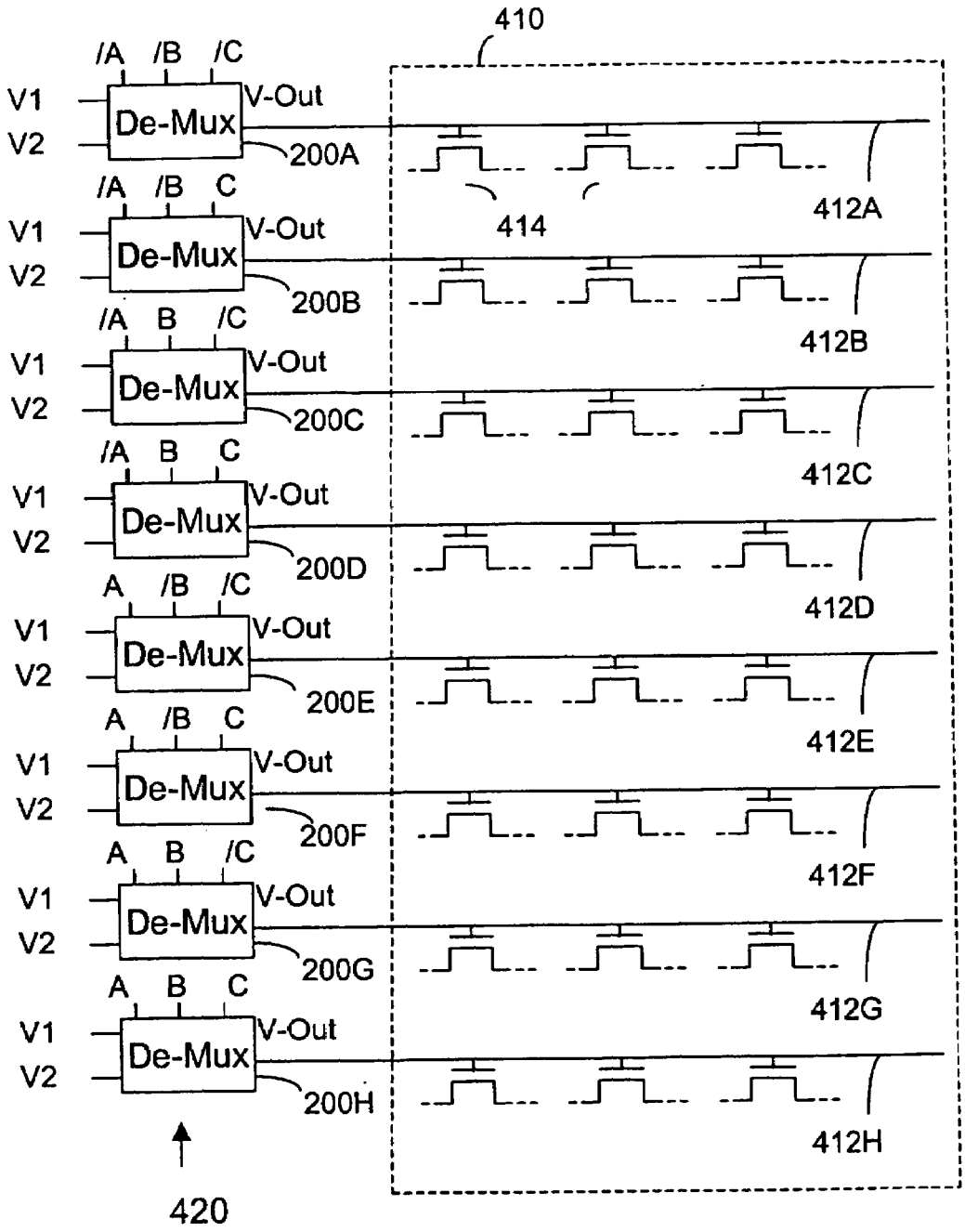
FIG. 4 is a schematic diagram showing an array driver 420 in accordance with one embodiment of the present invention and a pixel array 410.

FIG. 4 shows an array driver 420 in accordance with one embodiment of the present invention and a pixel array 410. The pixel array 410 includes a plurality of pixels (not shown), a plurality of switching transistors 414 and row lines (gate lines) 412A, 412B, . . . , 412H, each of which selects a corresponding switching transistor 414. The array driver 420 may be fabricated on the array 410.

The array 410 may be a a-Si:H, poly-crystalline silicon, or organic/polymer display or imaging arrays.

The array driver 420 has one or more de-multiplexer circuit block. Each row line in the array 410 is connected to one gate de-multiplexer circuit block. As shown in FIG. 4, in the case of an array with 8 rows, the array driver 420 includes 8 de-multiplexer circuit blocks 200A, 200B, . . . , 200H and 3 control lines are provided to the array driver 420.

In FIG. 4, V1 denotes an address signal and V2 denotes a gate selecting signal. One V1 line and one V2 line are provided to all de-multiplexer circuit blocks. However, a plurality of V1 lines and V2 lines may be provided to the de-multiplexer circuit blocks. Each de-multiplexer circuit block may include a circuit similar to the de-multiplexer 200 shown in FIG. 3.

Each de-multiplexer circuit block is controlled by either A, B, or C, or their complements /A, /B, /C as shown in FIG. 4. The control signals are activated such that only one de-multiplexer circuit block will be functional atone time, and each one will be turned on and off in sequence. The control signals are square waves of different frequencies such that their logic levels follow the binary count from 000 to 111.

For example, the de-multiplexer circuit block 200H is turned "ON" when the control signals A, B, and C are all at logic 'high'. At this point, voltage V1 is transmitted to the gate of the drive transistor (e.g. TFT 308 in FIG. 3). Voltage V1 is a pulsed source. When V1 is 'high', the drive TFT (308) is turned "ON". At that point, voltage V2 will be written to the corresponding row (e.g. 412H) of the array. The pulse width of V2 is long enough to allow time for data to be written to the corresponding row of the array. Once the data writing operation is complete, V2 becomes 'low', thus pulling down the voltage on the row line. After that V1 also becomes 'low', thus pulling down the gate voltage of the drive TFT (308). Subsequently the one or more of the control signals can change, so that the series connected TFTs (302 to 306) do not allow V1 to be written to the gate of the drive TFT (308).

Figure 5:
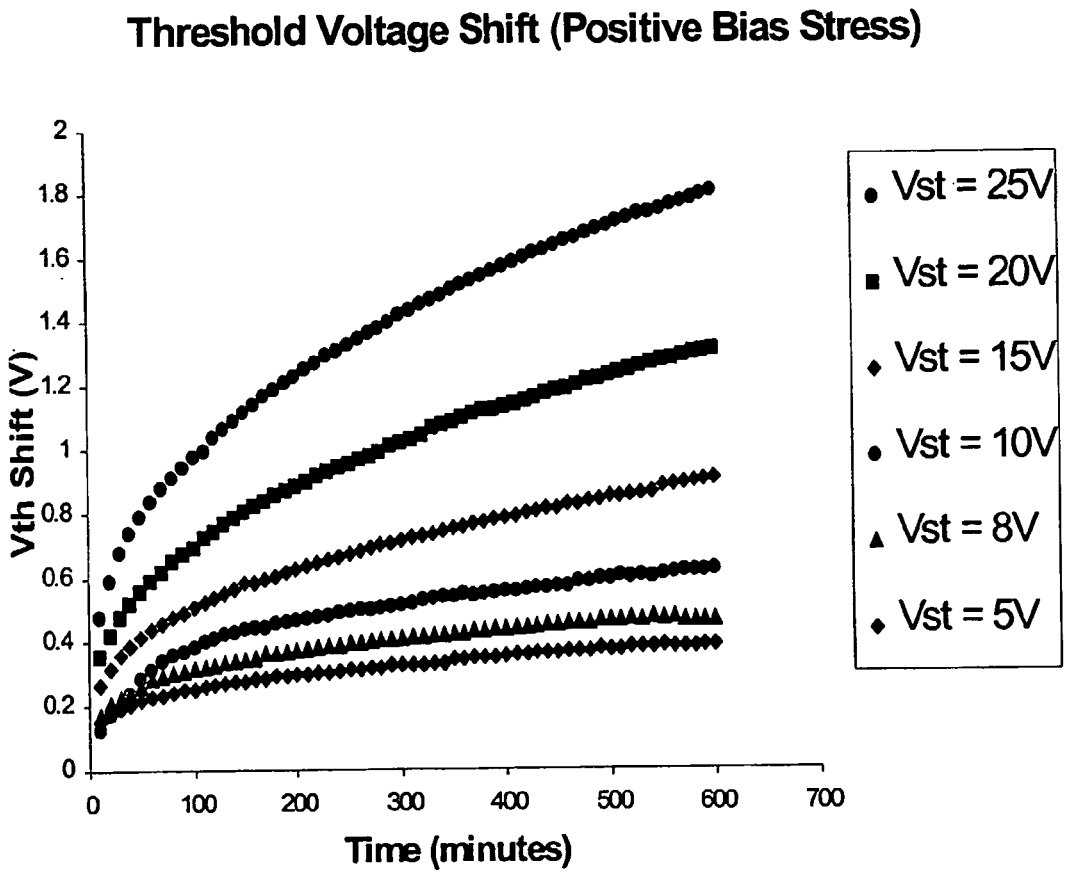
FIG. 5 is a diagram showing a threshold voltage shift of a TFT.
Figure 6:
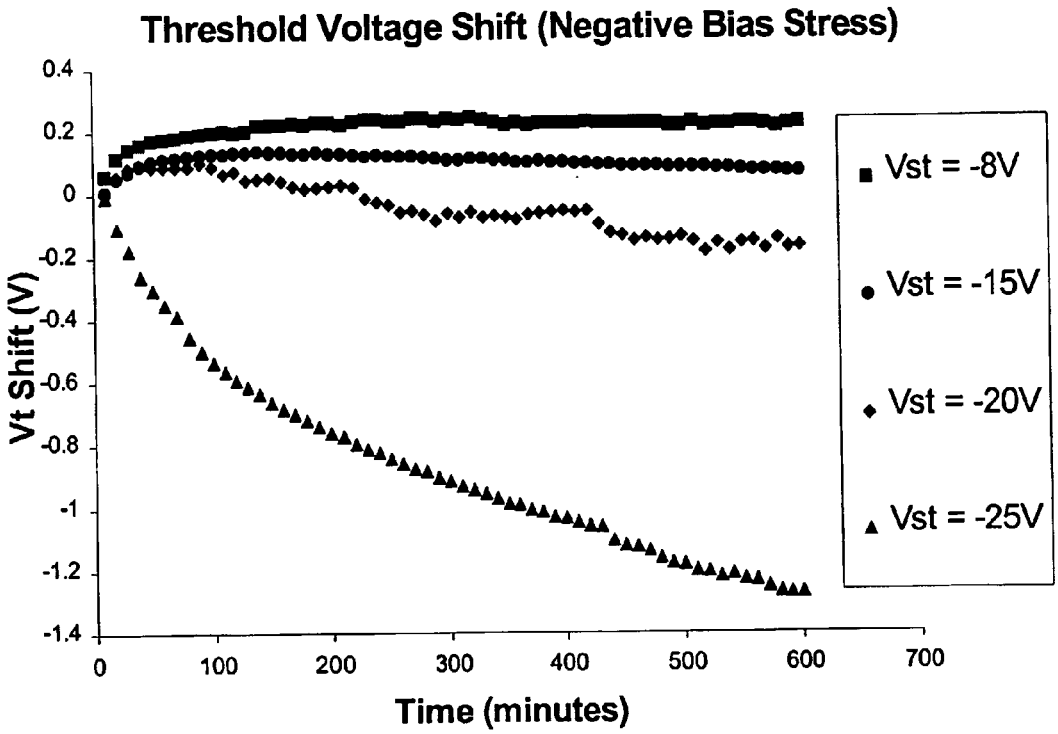
FIG. 6 is a diagram showing a threshold voltage shift of a TFT.

Threshold Voltage Stability:

The threshold voltage ($V_t$) of a TFT changes when it is under prolonged gate bias stress. TFTs show different threshold voltage shift behaviour under positive and negative gate bias stress as shown in FIG. 5 and FIG. 6. In FIGS. 5 and 6, "Vst" denotes a gate bias stress and "Vth" denotes a threshold voltage of a TFT.

The Vt increases with respect to the positive stress voltage as well as the stress duration. However, Vt can be decreased by applying large negative voltages to the gate of the TFT. Hence, to prevent the Vt of any TFT from increasing, it is desirable that the TFT experiences negative bias stress such that it is equal and opposite to the positive bias stress that it experiences.

In the de-multiplexer circuit of the embodiment of the present invention, this is ensured by making the gate voltage of all TFTs negative when they are in the "OFF" state. This means that V1, V2, and the control signals are at a negative voltage in logic state 'low', and at a positive voltage in logic state 'high'.

Figure 7:
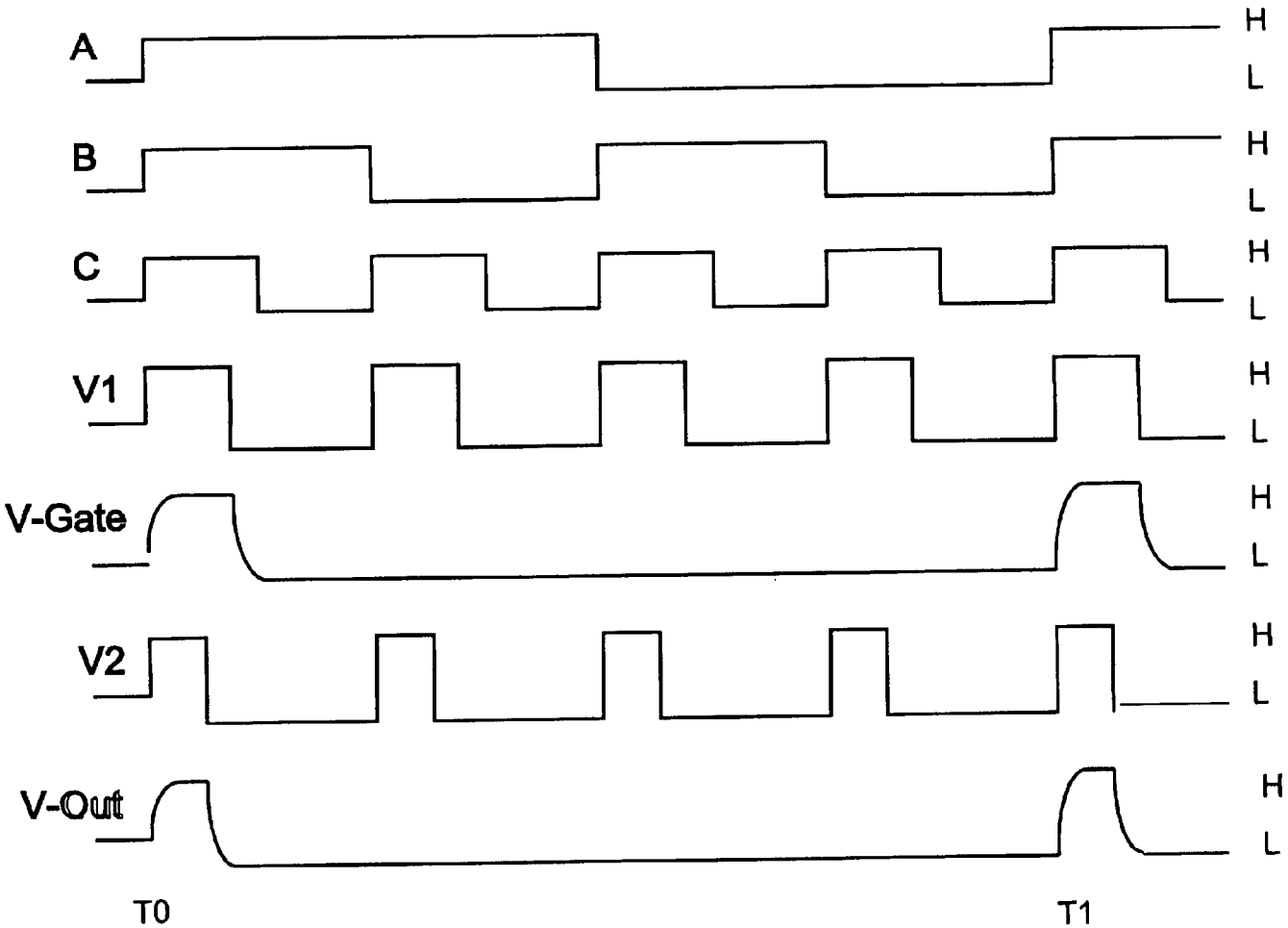
FIG. 7 is a timing chart showing operation of the de-multiplexer of FIGS. 2, 3 and 4.

FIG. 7 is a timing chart showing the operation of one de-multiplexer circuit block in accordance with one embodiment of the present invention. FIG. 7 shows the relative voltage levels of all input and output signals, along with their duty cycles. "H" denotes a logic state "high", and "L" denotes a logic state "low". V1, V2, and the control signals are at a negative voltage in logic state "L", and at a positive voltage in logic state "H".

In the de-multiplexer circuit of the embodiment of the present invention, the switching TFTs (e.g., TFTs 302,304, 306 in FIG. 3) are "ON" 50% of the time because the control signals have a duty cycle of 50%. V1 appears at the gate of the drive TFT (e.g. TFT 308 in FIG. 3) only once per frame (T0-T1). "Frame" refers to the writing/reading of one set of image information to/from the array. Hence the drive TFT will experience negative bias stress for the rest of the time. Similarly, V2 is transmitted to any particular row line of the array only one per frame. These duty cycles ensure that the Vt of none of the transistors will increase during operation of the de-multiplexer.

Figure 8:
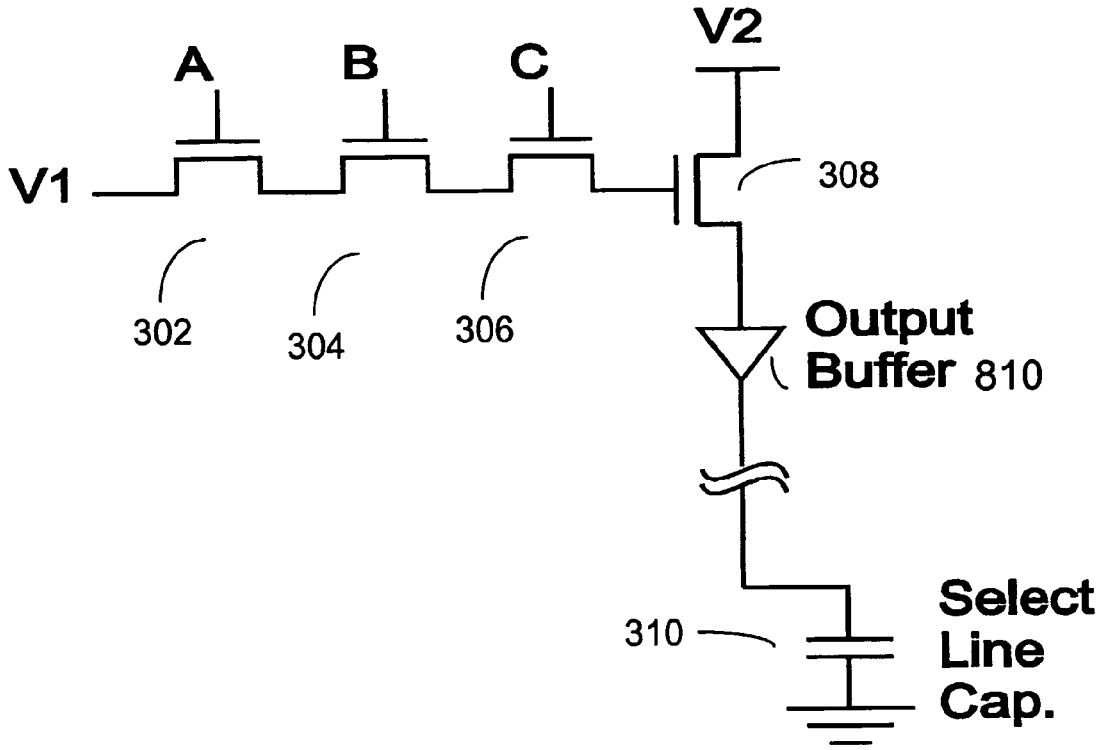
FIG. 8 is schematic diagram showing a de-multiplexer and an output buffer in accordance with one embodiment of the present invention.

Addition of an Output Buffer:

An output buffer can be added at the output of each de-multiplexer circuit block. FIG. 8 shows the de-multiplexer 200 and an output buffer 810 connected to the de-multiplexer 200. The output buffer 810 is connected to the source terminal of the drive TFT 308.

The output terminal V-Out may be connected to the input of the output buffer 810. The output buffer 810 may be included in the de-multiplex circuit block 200. The output buffer 810 may include an a-Si:H, poly-crystalline silicon, or organic/polymer TFT.

This buffer 810 allows the drive TFT 308 to rapidly raise or lower the row line voltage to the desired level even if the row line capacitances are very high.

Figure 9:
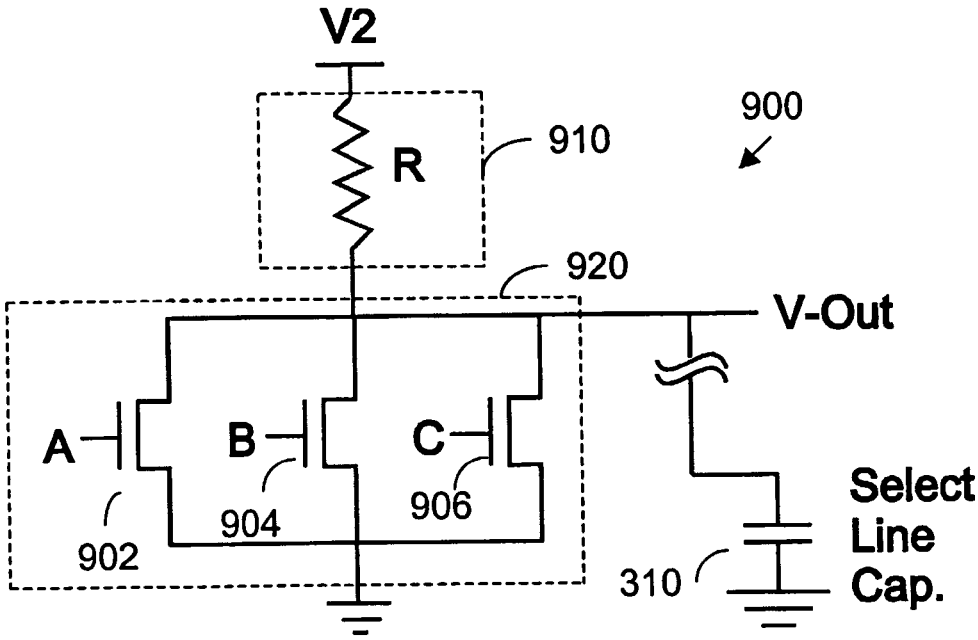
FIG. 9 is a schematic diagram showing a pull-up/pull-down network based de-multiplexer circuit 900 in accordance with another embodiment of the present invention.

Variation of the Multiplexer Architecture:

FIG. 9 shows a de-multiplexer circuit 900 in accordance with anther embodiment of the present invention. The de-multiplexer 900 in FIG. 9 has a pull-up network 910, a pull-down network 920. The three series TFTs in FIG. 3 are replaced by the pull-up network 910 including a resistor R, and the pull-down network 920 including three parallel TFTs 902, 904 and 906. The TFTs 902, 904 and 906 may be a-Si:H, poly-crystalline silicon, or organic/polymer TFTs.

The resistor R is connected between V1 and the terminal V-Out, and each of the TFTs 902, 904 and 906 is connected between the terminal V-Out and a ground.

Three control signals A, B and C are supplied to the gates of the TFTs 902, 904 and 906, respectively. A pulsed voltage is applied to the terminal V2.

The output terminal V-Out may be connected to the gate line (e.g., 412H in FIG. 4) in the array (410 in FIG. 4). V2 may be negative when it is in a logic state "low". That ensures the threshold voltage stability as described above.

The pull up network 910 allows the gate line voltage to be raised to the desired positive voltage, and the pull-down network 920 allows the gate line voltage to be lowered to the desired negative voltage.

Figure 10:
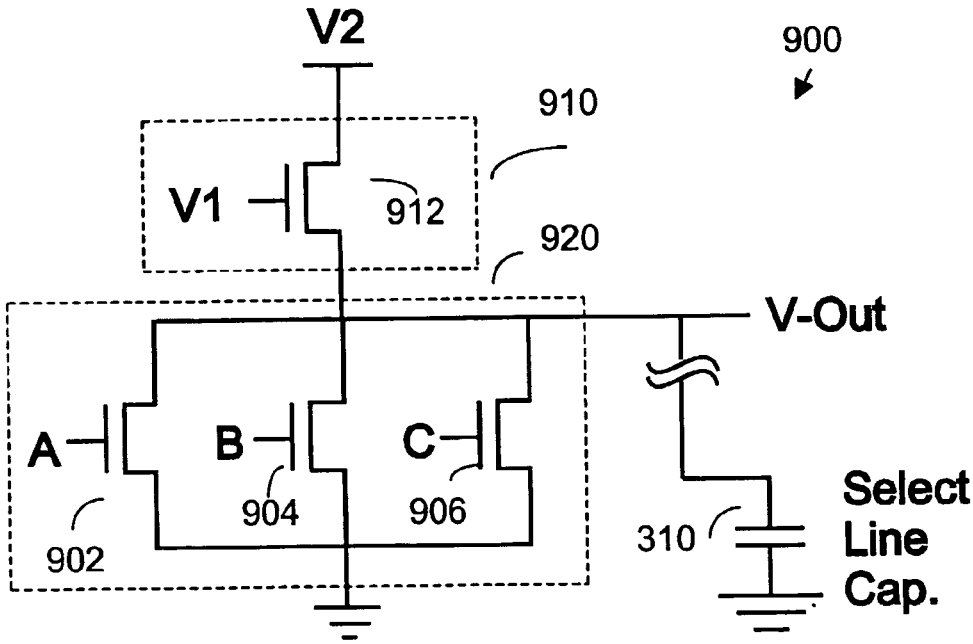
FIG. 10 is a schematic diagram showing anther example of the de-multiplexer circuit 900 of FIG. 9.

FIG. 10 shows another example of the de-multiplexer 900. In FIG. 10, the resistor R is replaced by a diode-connected TFT 912.

The de-multiplexer 900 of FIGS. 9 and 10 can be applied to the array driver 420 of FIG. 4 and can be integrated with the array 410 in FIG. 4.

Use of the De-Multiplexer Circuit as a Multiplexer

The de-multiplexer circuit architecture in accordance with the embodiments of the present invention can also be used to create a multiplexer.

Figure 11:
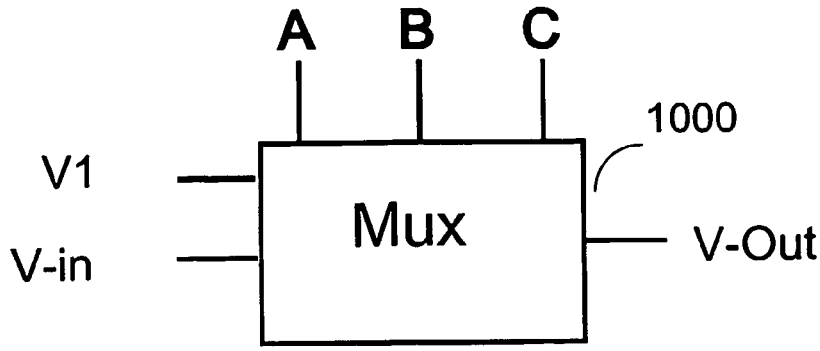
FIG. 11 is a block diagram showing a multiplexer circuit block 1000 in accordance with one embodiment of the present invention.

A multiplexer circuit block 1000 in accordance with one embodiment of the present invention is shown in FIG. 11. The multiplexer circuit block 1000 includes a plurality of TFTs, which may be a-Si:H, polycrystalline silicon, or organic/polymer TFTs. The TFTs are connected in series, and whose gate terminals are controlled by external control signals A, B and C. The multiplexer circuit block 1000 has an input terminal V-in, an output terminal V-Out, control terminals A, B and C and a terminal V1. The multiplexer 1000 can be fabricated on the array (e.g., 410 in FIG. 4).

Figure 12:
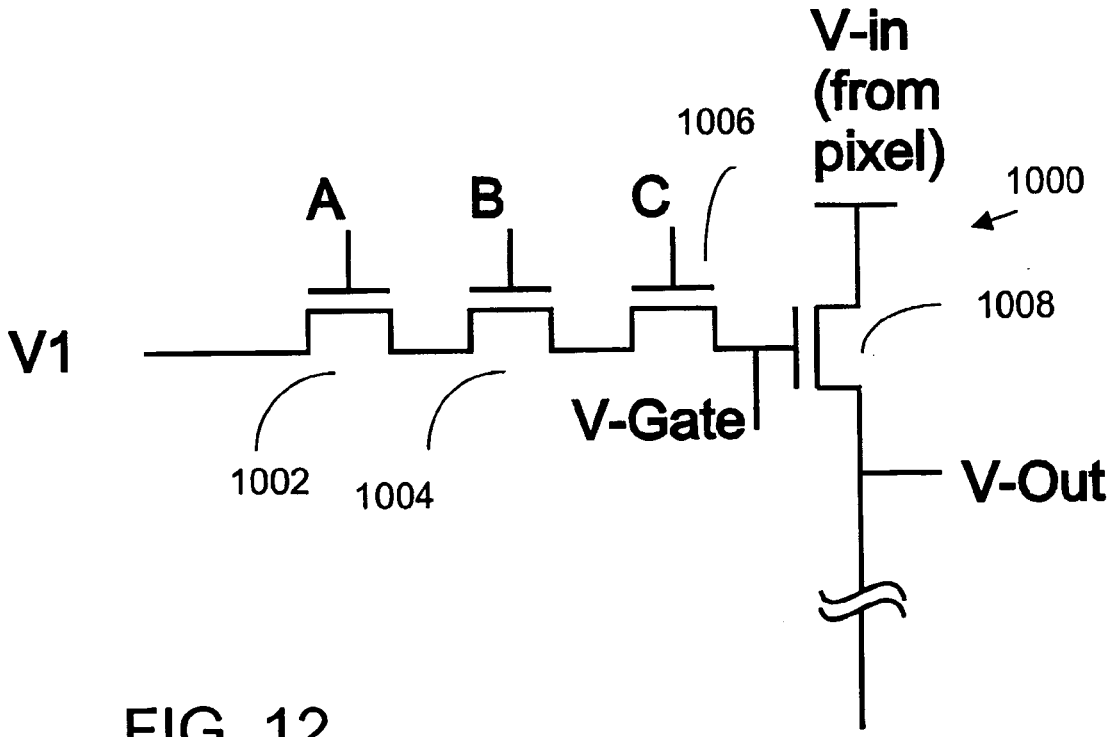
FIG. 12 is a circuit diagram showing one example of the multiplexer circuit block 1000 of FIG. 11.

FIG. 12 shows one example of the multiplexer circuit block 1000 of FIG. 11. The multiplexer 1000 in FIG. 12 includes TFTs 1002, 1004 and 1006 that are connected in series. The TFTs 1002, 1004 and 1006 may be a-Si:H, poly-crystalline silicon, or organic/polymer TFTs. The TFTs 1002, 1004 and 1006 are controlled by control signals A, B and C, respectively. In FIG. 12, TFTs 1002, 1004 and 1006 and control signals A, B and C are shown. However, the multiplexer may have any number of TFTs and the number of control signals is not limited.

This multiplexer is useful in imaging arrays during the read-out phase. The imaging array is one of active matrix array. In a-Si:H, poly-crystalline silicon or organic/polymer based imaging arrays, imaging pixels are activated row-by-row during image read-out. During the read-out phase, image data is sent out serially using a multiplexer as described below.

The structure of the multiplexer is similar to that of the de-multiplexer shown in FIG. 3, except that the input signal V2 is now different. The drain of the drive TFT 1008 is connected to the source of the TFT in the imaging array pixel, and will be supplied with a data voltage from the pixel.

Pulsed voltage V1 is supplied to one end of the series of TFTs (i.e., TFT 1002) and the other end drives the gate of a transistor 1008. The transistor 1008 is a relatively large drive TFT. The drive TFT 1008may be an a-Si:H, poly-crystalline silicon, or organic/polymer TFT. The drain of the TFT 1008 is connected to a terminal V-in. The V-in is connected to a data line in an imaging array as described below. The source of the TFT 1008 is connected to an output terminal V-Out.

Figure 13:
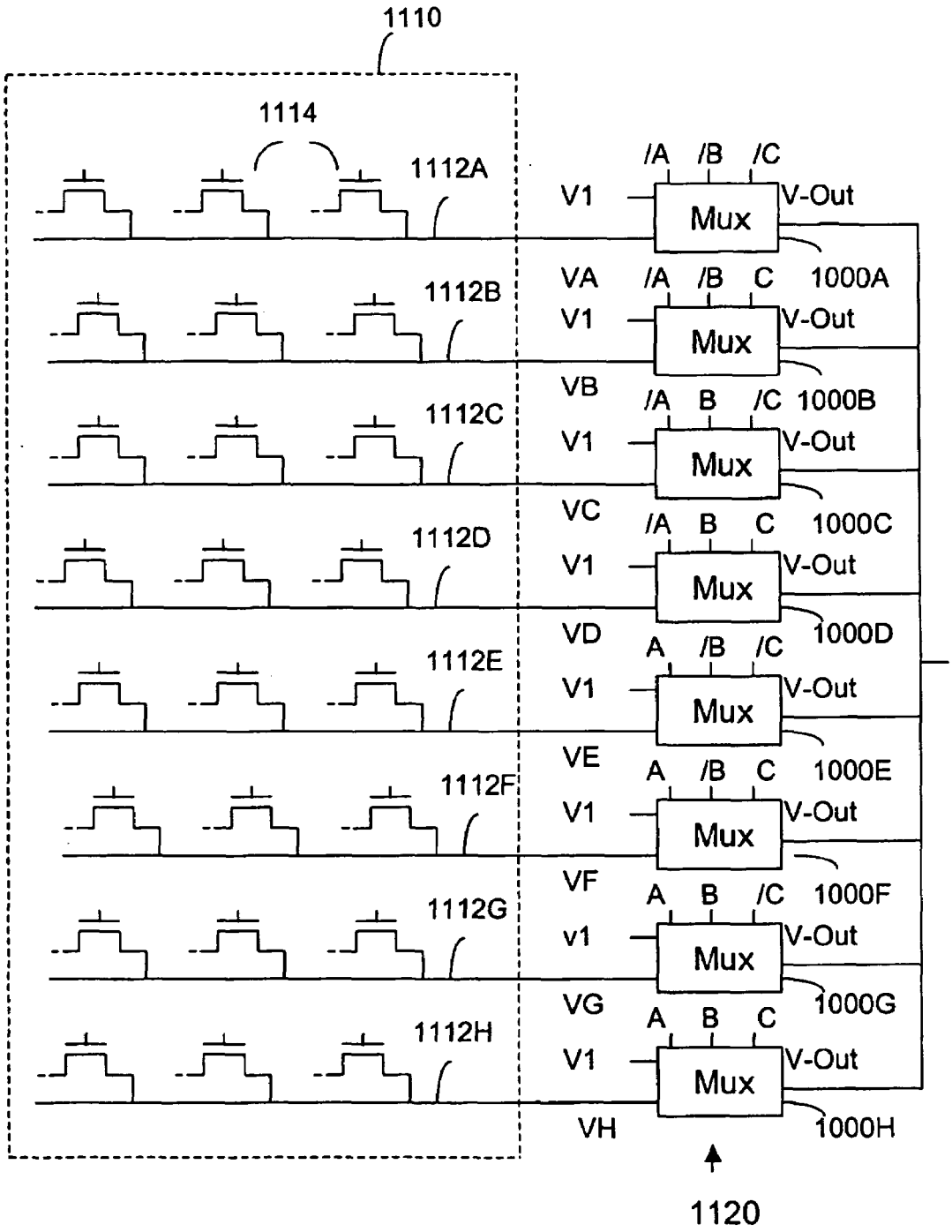
FIG. 13 is a schematic diagram showing a read circuit 1120 in accordance with one embodiment of the present invention and an imaging array 1110.

FIG. 13 shows showing a read circuit 1120 in accordance with one embodiment of the present invention and an imaging array 1110. The imaging array 1110 includes a plurality of pixels (not shown), a data line 1112A, 1112B, . . . , 1112H and a transistor 1114.

The imaging array 1110 may be a a-Si:H, poly-crystalline silicon, or organic/polymer TFTs based imaging array and the transistor 1114 may be an a-Si:H, polycrystalline silicon, or organic/polymer TFT.

The source of the TFT 1114 is connected to a corresponding data line. Each data line in the array 1110 is connected to one multiplexer circuit block. As shown in FIG. 13, in the case of an array with 8 data lines, 8 multiplexer circuit blocks 1000A, 1000B, . . . , 1000H and 3 control lines are provided to the read circuit 1120. Each multiplexer is similar to the multiplexer 1000 shown in FIG. 12. "VA", "VB" . . . , "VH" in FIG. 13 correspond to "V-in" in FIGS. 11 and 12.

A combination of control signals A, B, and C activates one multiplexer circuit block. That circuit block will now allow V1 to appear at the gate of the drive TFT (e.g., TFT 1008 in FIG. 12). When V1 is 'high', the drive TFT (1008) allows the image data voltage to appear at the output. When V1 becomes 'low', the drive TFT (1008) is in the "OFF" state. To avoid Vt increases in the drive TFT (1008) over a period of time, V1 is negative when it is in logic state "low" and V1 is positive when it is in logic state "high". Also, the control signals are at a negative voltage in logic state "low", and at a positive voltage in logic state "high". For example, the multiplexer is operated by V1, A, B and C shown in FIG. 7.

Figure 14:
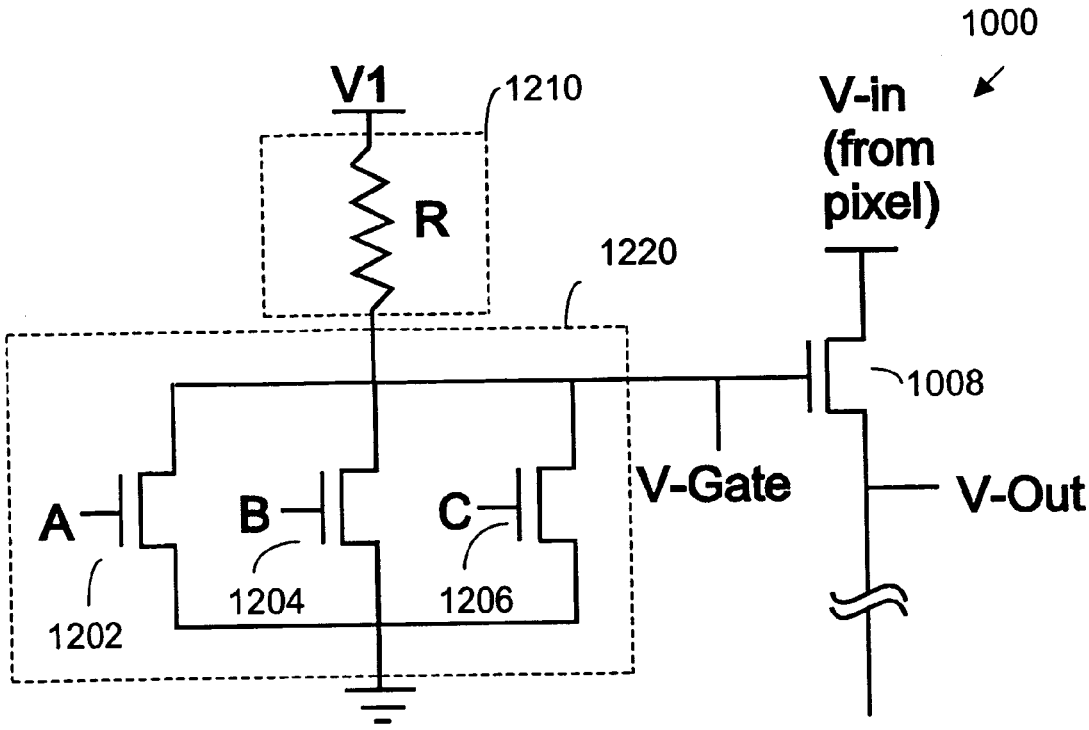
FIG. 14 is a circuit diagram showing a pull-up/pull-down network based multiplexer circuit 1000.

Variation of the Multiplexer Architecture:

FIG. 14 shows anther example of the multiplexer circuit 1000 of FIG. 11. The multiplexer 1000 in FIG. 14 has a pull-up network 1210, a pull-down network 1220 and the drive TFT 1008. In order to increase the switching speed, the three series TFTs (1002 to 1006) in FIG. 12 have been replaced by the pull-up network 1210 including a resistor R, and the pull-down network 1220 including three parallel TFTs 1202, 1204 and 1206. The TFTs 1202, 1204 and 1206 may be a-Si:H, poly-crystalline silicon, or organic/polymer TFTs.

The resistor R is connected between V1 and the gate of the drive TFT 1008, and each of the TFTs 1202, 1204 and 1206 is connected between the gate of the drive TFT 1008 and a ground.

A, B, and C are the three control signals, which are supplied to the gates of the TFTs 1202, 1204 and 1206, respectively. V1 is a pulsed voltage that is negative when it is 'low'. Also, the control signals A, B and C are negative when it is "low". That ensures that the Vt of the transistors will not increase during operation of the multiplexer.

V-in terminal is connected to the data line (e.g., the data line 1112A in FIG. 13) that needs to be multiplexed. The operation of this circuit is similar to that of the circuit in FIG. 12 except that the time delay in switching the drive TFT 1008 on or off has been substantially reduced. In this circuit, the resistor R can also be replaced by a diode-connected TFT.

Figure 15:
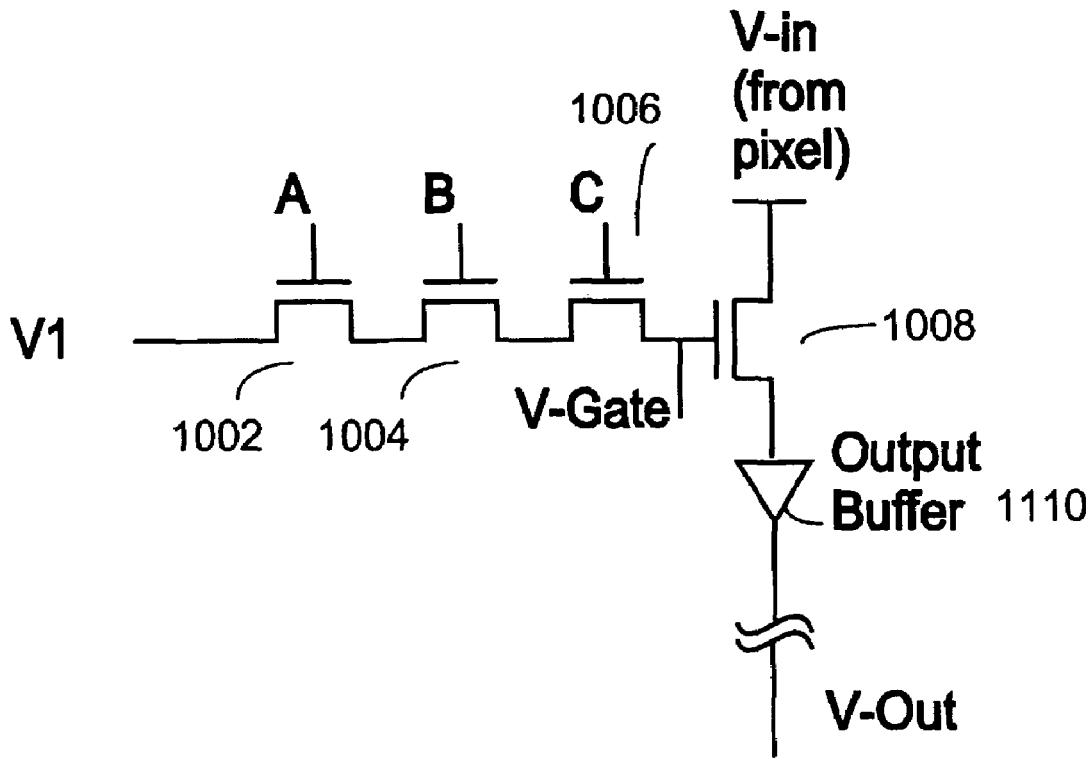
FIG. 15 is a schematic diagram showing a multiplexer and an output buffer in accordance with one embodiment of the present invention.

Addition of an Output Buffer:

An output buffer can be added at the output of each multiplexer circuit block. FIG. 15 shows the multiplexer 1000 and an output buffer 1110 connected to the multiplexer 1000. The output buffer 1110 is connected to the source terminal of the drive TFT 1008.

The output terminal V-Out is connected to the output of the output buffer 1110. The output buffer 1110 may be included in the multiplex circuit block 1000L The output buffer 1110 may include an a-Si:H, poly-crystalline silicon, or organic/polymer TFT.

The output buffer 1110 allows the drive TFT 1008 to rapidly raise or lower the row line voltage to the desired level.

Cascading of Multiplexers/De-Multiplexers to Reduce Vt-Shifts:

In order to further reduce the effect of gate bias stress on TFTs in the multiplexer/de-multiplexer circuits presented here, the individual blocks can be cascaded to form a larger unit.

Figure 16:
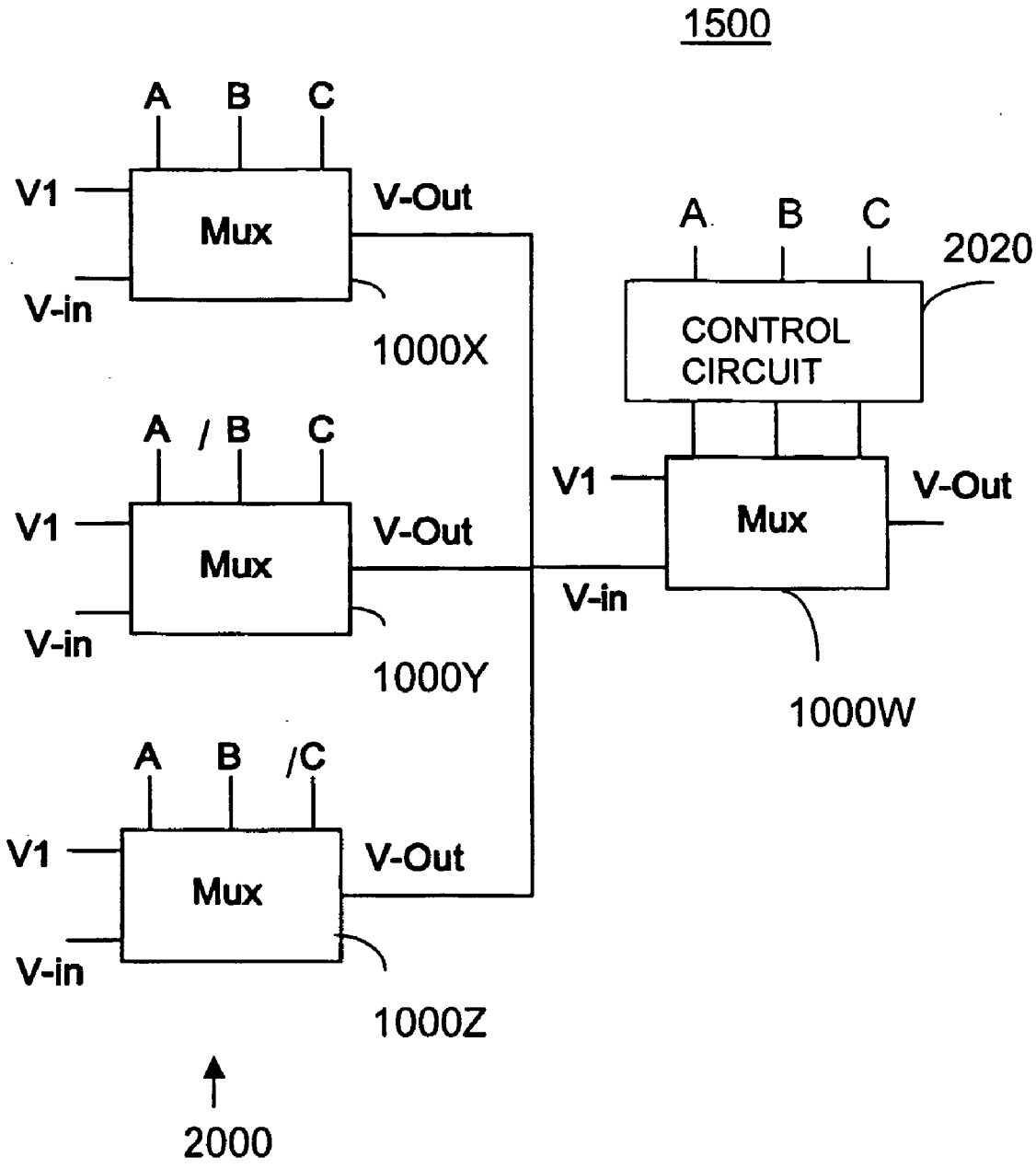
FIG. 16 is a block diagram showing one configuration of cascaded multiplexers block 1500 in accordance with one embodiment of the present invention.

FIG. 16 shows a cascaded multiplexers block 1500 in accordance with one embodiment of the present invention. In FIG. 16, the cascaded multiplexers block 1500 includes a front-process block 2000 including multiplexers 1000X, 1000Y, 1000Z, and a multiplexer 1000W. The multiplexers 1000X to 1000W may be similar to that of FIGS. 12, 14 or 15.

In the front-process block 2000, each multiplexer is activated in response to a combination of the control signals A, B and C and their complements /A, /B and /C. In the front-process block 2000, one multiplexer is activated depending on the combination of the control signals.

The input V-in of the multiplexer 1000W receives the outputs of the multiplexers 1000X to 1000Z. The multiplexer 1000W receives the control signals through a control circuit 2020. The multiplexer 1000W is activated when any one of the multiplexers in the front-process block 2000 is activated.

Figure 17:
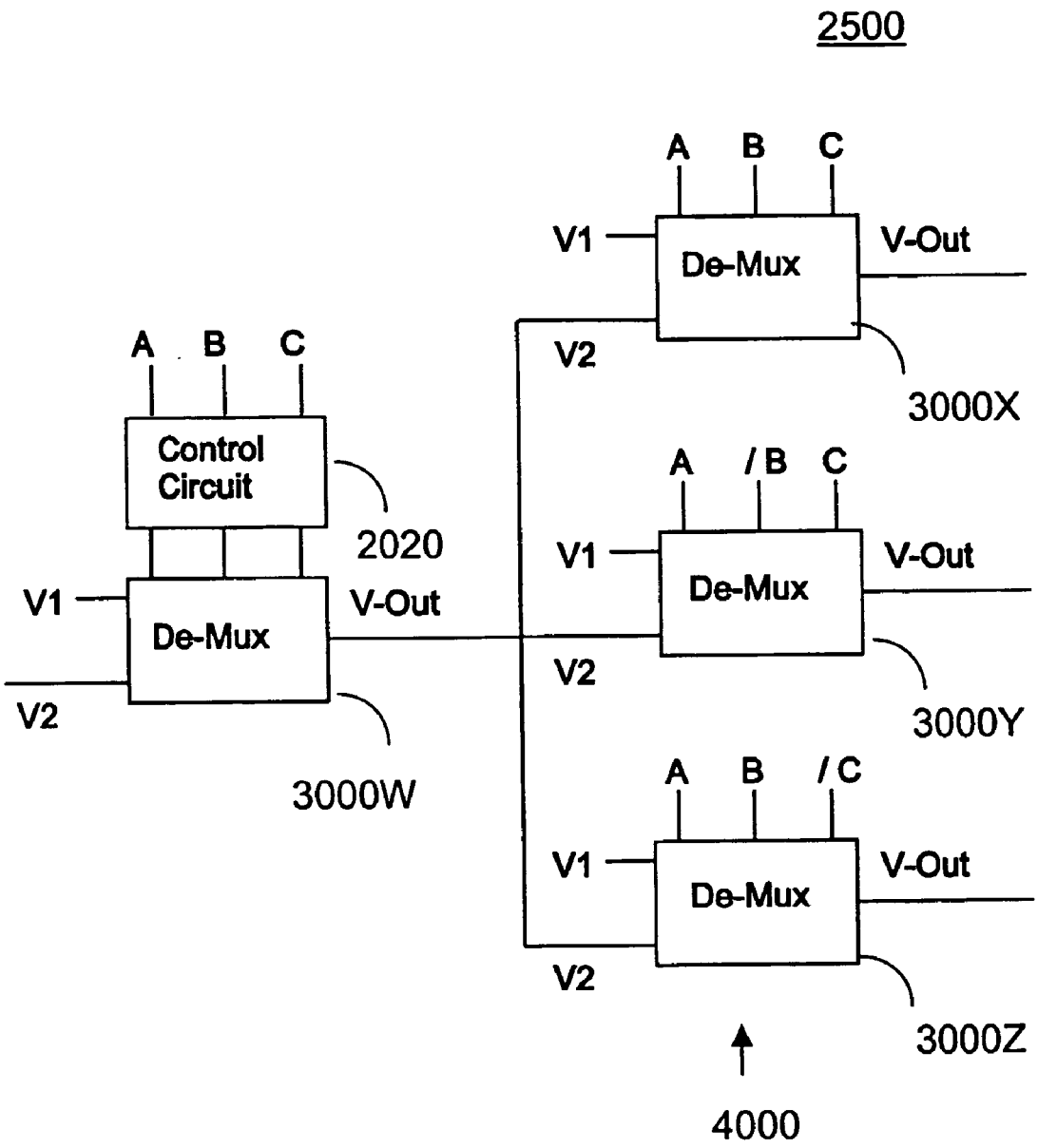
FIG. 17 is a block diagram showing one configuration of cascaded de-multiplexers block 2500 in accordance with one embodiment of the present invention.

FIG. 17 shows a cascaded de-multiplexers block 2500 in accordance with one embodiment of the present invention. In FIG. 17, the cascaded de-multiplexers block 2500 includes a de-multiplexer 3000W and a post-process block 4000 including de-multiplexers 3000X, 3000Y and 3000Z. The de-multiplexers 3000X to 3000W may be similar to that of FIGS. 3 and 8 to 10.

In the post-process block 4000, each de-multiplexer is activated in response to a combination of the control signals A, B and C and their complements /A, /B and /C. In the post-process block 4000, one de-multiplexer is activated depending on the combination of the control signals.

The de-multiplexer 3000W receives the control signals through the control circuit 2020. The multiplexer 3000W is activated when any one of the de-multiplexers in the post-process block 4000 is activated. The output V-Out of the de-multiplexer 3000W is supplied to V2 terminals of the de-multiplexers 3000X to 3000Z.

In cascaded multiplexers and de-multiplexers, only one path is in ON at any given time. Thus, the TFTs in the OFF paths will have a negative gate bias and will have enough time to recover from any Vt-shift that may have occurred.

The de-multiplexer and the multiplexer in accordance with the embodiments of the present invention can apply to a-Si:H, polycrystalline silicon, and organic/polymer thin film transistor active-matrix arrays. Further, the de-multiplexer and the multiplexer can be fabricated on the arrays.

Numerous modifications, variations and adaptations may be made to the particular embodiments of the invention described in the documents attached herein, without departing from the scope of the invention, which is defined in the claims.

What is claimed is:

1. A drive circuit for driving a row of pixel in a display or imaging application having a plurality of pixels, the drive circuit comprising:

an output terminal connected to a gate line or the row, the gate line connected to the gate terminal of a switching transistor of a pixel in the row;

a drive transistor connected to the output terminal, the drive transistor for transferring a gate selecting signal to the gate line of the row;

a series of control transistors comprising a plurality of transistors serially connected, the series of control transistors having a first terminal and a second terminal at opposite ends of the series of control transistors, the first terminal of the series of control transistors connected to the gate terminal of the drive transistor, the series of control transistors for transferring an addressing signal from the second terminal of the series of control transistors to the gate terminal of the drive transistor to control the transferring of the gate selecting signal to the gate line of the row; and a plurality of control signals connected to the gate terminals of the plurality of control transistors for controlling the transferring of the addressing signal to the gate of the drive transistor, herein the drive transistor, the plurality of control transistors and the switching transistor of the pixel are each a thin film transistor.

2. The drive circuit as claimed in claim 1 further comprising an output buffer connected to the source terminal of the drive transistor, the drain terminal of the drive transistor receiving the gate selecting signal.

3. The drive circuit as claimed in claim 1, wherein each of the control signals has a duty cycle of 50%.

4. The drive circuit as claimed in claim 1, wherein each of the one or more control signals, the switching signal and the gate selecting signal is at a negative voltage in a logic state "low", and each of the one or more control signals, the switching signal and the gate selecting signal is at a positive voltage in a logic state "high".

5. The drive circuit as claimed in claim 1, wherein the thin film transistor is derived from an inorganic or organic/polymer material.

6. The drive circuit as claimed in claim 5, wherein the thin film transistor is an amorphous silicon transistor or a polycrystalline silicon transistor.

7. The drive circuit as claimed in claim 1, further comprising a pull up network circuit for pulling up a voltage of the gate line and/or a pull down network circuit for pulling down the voltage of the gate line.

8. A system for driving a pixel array in a display or imaging application, having a plurality of pixels arranged in a plurality of rows, the system comprising a plurality of drive circuits, each drive circuit being the drive circuit of claim 1, the output terminals of the drive circuits connected to gate lines of the plurality of rows, the gate line of a row connected to a switching transistor of a pixel in the row.

9. The system as claimed in claim 8, wherein the plurality of drive circuits are integrated with the pixel array.

10. The system as claimed in claim 8, wherein the plurality of control signals are activated such that one of the plurality of drive circuits is selectively activated at one time to transfer the gate selecting signal to the gate line of the row.

11. The system as claimed in claim 8, wherein each of the drive circuits further comprises a pull up network circuit for pulling up a voltage of the gate line and/or a pull down network circuit for pulling down the voltage of the gate line.

12. The system as claimed in claim 8, wherein the thin film transistor includes an amorphous silicon, a poly-crystalline silicon, an inorganic or organic/polymer material.

13. The system as claimed in claim 8, further comprising a de-multiplexer for operating on the gate selecting signal provided to more than one drive circuits.

14. A read circuit for reading a row of pixels in a display or imaging application having a plurality of pixels, the drive circuit comprising:

an output terminal;

an input terminal connected to a data line of the row, the data line connected to the gate terminal of a switching transistor of a pixel in the row, the switching transistor for transferring the data from the pixel to the data line;

a drive transistor connected between the input terminal and the output terminal, the drive transistor for transferring data on the data line to the output terminal;

a series of control transistors comprising a plurality of transistors serially connected, the series of control transistors having a first terminal and a second terminal at opposite ends of the series of control transistors, the first terminal of the series of control transistors connected to the gate terminal of the drive transistor, the series of control transistors for transferring an addressing signal from the second terminal of the series of control transistors to the gate terminal of the drive transistor to control the transferring of the data to the output terminal; and a plurality of control signals connected to the gate terminals of the plurality of control transistors for controlling the transferring of the addressing signal to the gate of the drive transistor, wherein the drive transistor, the plurality of control transistors and the switching transistor of the pixel are each a thin film transistor.

15. The read circuit as claimed in claim 14, wherein each of the control signals has a duty cycle of 50%.

16. The read circuit as claimed in claim 14, wherein each of the control signals and the switching signal is at a negative voltage in a logic state "low", and is at a positive voltage in a logic state "high".

17. The read circuit as claimed in claim 14, further comprising a pull up network circuit for pulling up a gate voltage of the drive transistor, a pull down network circuit for pulling down the gate voltage of the drive transistor or a combination thereof.

18. The read circuit as claimed in claim 17, wherein the pull down network circuit includes at least one transistor, and wherein the at least one transistor of the pull down network circuit is connected between the gate of the drive transistor and a ground.

19. The read circuit as claimed in claim 14, further comprising an output buffer connected to the output terminal.

20. The read circuit as claimed in claim 14, wherein the thin film transistor is derived from an inorganic or organic/polymer material.

21. The read circuit as claimed in claim 14, wherein the thin film transistor is an amorphous silicon transistor or a polycrystalline silicon transistor.

22. A system for reading a pixel array in a display or imaging application, having a plurality of pixels arranged in a plurality of rows, the system comprising a plurality of read circuits, each read circuit being the read circuit of claim 14, the input terminals of the read circuits connected to data lines of the plurality of rows, the data line of a row connected to a switching transistor of a pixel in the row.

23. The system as claimed in claim 22, wherein the plurality of reading circuits are integrated with the pixel array.

24. The system as claimed in claim 22, wherein each of the read circuits further comprises a pull up network circuit for pulling up a gate voltage of the drive transistor, a pull down network circuit for pulling down the gate voltage of the drive transistor or a combination thereof.

25. The system as claimed in claim 22, wherein each of the read circuits further comprises an output buffer connected to the output terminal.

26. The system as claimed in claim 22, wherein the plurality of control signals are activated such that one of the plurality of read circuits is selectively activated at one time.

27. The system as claimed in claim 22, wherein the thin film transistor is derived from an inorganic or organic/polymer material.

28. The system as claimed in claim 22, wherein the thin film transistor is an amorphous silicon transistor or a polycrystalline silicon transistor.

29. The system as claimed in claim 22, further comprising a multiplexer for operating on outputs of more than one read circuits.

* * * * *

UNITED STATES PATENT AND TRADEMARK OFFICE

CERTIFICATE OF CORRECTION

PATENT NO. : 7,573,452 B2
APPLICATION NO. : 10/487034
DATED : August 11, 2009
INVENTOR(S) : Arokia Nathan et al.

It is certified that error appears in the above-identified patent and that said Letters Patent is hereby corrected as shown below:

Column 8, line 44, delete "or" and insert therefor --of--.

Column 8, line 65, delete "herein" and insert therefor --wherein--.

Column 9, line 1, after "1" insert --,--.

Signed and Sealed this

Sixth Day of October, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,573,452 B2
APPLICATION NO. : 10/487034
DATED : August 11, 2009
INVENTOR(S) : Nathan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1139 days.

Signed and Sealed this

Seventh Day of September, 2010

David J. Kappos

David J. Kappos
*Director of the United States Patent and Trademark Office*